US005507418A

United States Patent [19]

Dobbs et al.

[11] Patent Number: 5,507,418

[45] Date of Patent: Apr. 16, 1996

[54] FLUID DISPENSER WITH INTERFERENCE FIT GASKET

[75] Inventors: Douglas B. Dobbs, Yorba Linda; Ron E. Harriman, Montebello, both of Calif.

[73] Assignee: Calmar Inc., City of Industry, Calif.

[21] Appl. No.: 396,527

[22] Filed: Mar. 1, 1995

[51] Int. Cl.[6] ..... B67D 5/42

[52] U.S. Cl. ..... 222/383.1; 222/542; 277/11; 277/215

[58] Field of Search ..... 222/38 L, 383.1, 222/542, 568; 277/9.5, 11, 215

[56] References Cited

U.S. PATENT DOCUMENTS

| | | | |
|---|---|---|---|
| 1,682,234 | 8/1928 | Moyer | 215/345 |
| 1,882,278 | 10/1932 | Francyk | 215/329 |
| 3,371,813 | 5/1968 | Owen | 215/318 |
| 3,421,648 | 1/1969 | Giessler | 215/276 |
| 3,587,940 | 6/1971 | Ellis | 222/383.1 |
| 3,685,739 | 8/1972 | Vanier | 222/383.1 |
| 4,325,487 | 4/1982 | Libit | 215/330 |
| 4,454,965 | 6/1984 | Kirk, Jr. | 222/383.1 |
| 4,982,900 | 1/1991 | Blake | 222/383.1 |
| 5,072,860 | 12/1991 | Dobbs | 222/383.1 |
| 5,337,928 | 8/1994 | Foster | 222/383.1 |

*Primary Examiner*—Andres Kashnikow
*Assistant Examiner*—Philippe Derakshani
*Attorney, Agent, or Firm*—Watson Cole Stevens Davis

[57] ABSTRACT

An interference fit is effected for a threaded closure cap used in mounting a trigger sprayer onto the threaded neck of a container by the provision of an oversized elastomeric gasket seal presenting at least one radially extending protrusion bent by the cap during the cap threading operation to lie between the cap and the container neck, the protrusion having a predetermined thickness to form the interference fit for increasing resistance to cap backoff.

4 Claims, 2 Drawing Sheets

FLUID DISPENSER WITH INTERFERENCE FIT GASKET

BACKGROUND OF THE INVENTION

This invention relates generally to gasket seal for a fluid dispenser mounted with the use of a freely rotatable closure cap threaded onto the neck of the container of product to be dispensed, and more particularly to such a gasket providing an interference fit between the cap and the container neck for increasing resistance to cap backoff.

U.S. Pat. No. 5,072,860, commonly owned herewith, discloses a sealing gasket having slip resistance means on opposing sides for engagement with like means on the lower edge of the pump body and the upper edge of the container neck to avoid slippage of the gasket seal which thereby prevents loosening of the tightened closure cap from the container neck which may cause leakage.

U.S. Pat. No. 4,325,487 discloses a thread cap having an internal helical fin to provide a wedging torque-controlled securement of the cap to the container.

U.S. Pat. No. 3,421,648 discloses a paper insert having projections along the periphery which fold along a securing band to permit removal of the insert as part of a storage assembly for a home food processing closure.

U.S. Pat. Nos. 1,682,234, 1,882,278 and 3,371,813 disclose closure lid sealing gaskets of various types.

U.S. Pat. No. 5,337,928 discloses a gasket seal having holes through which posts on the pump body extend for attaching the gasket to the lower end of the pump body for retaining the gasket within the freely rotatable closure cap.

The trigger sprayer is typically mounted on the container by provision of a freely rotatable, internally threaded closure cap which is torqued down over the external threads of the container neck. A gasket seal of elastomeric material is disposed in sealing engagement between the lower edge of the pump body and the upper edge of the container neck for sealing against leakage. The gasket seal normally has an outer diameter equal to the outer diameter of the container neck, and has an opening through which the dip tube extends from the pump body into the container. As shown in the U.S. Pat. No. 5,072,860, the gasket seal may be retained within the closure upon engagement with a tube retainer. Otherwise, the gasket seal may be attached to the pump body as in the U.S. Pat. No. 5,337,928.

During shipping, storage and handling of the dispensing package, the threaded closure oftentimes loosens, thereby presenting leakage problems. The approach taken in the U.S. Pat. No. 5,072,860 to resist rotation of the dispenser body in a loosening direction is satisfactory, although the ratchet teeth or other form of slip-resistant means must be formed on the gasket seal and cooperating parts of the dispensing package which requires additional molding steps, adding to the cost of production.

The present invention provides a simple and economical, yet highly effective approach in resisting cap backoff, which thereby avoids leakage after the closure cap is torqued down over the container neck using an intervening portion of the gasket seal. The gasket seal, according to the invention, is oversized relative to the inner dimension of the closure cap, such that the gasket seal is frictionally retained within the cap for free rotation together therewith, and a portion or portions of the oversized gasket is bent by the cap to lie between the cap and the container neck upon thread tightening the cap on the container neck. The gasket seal has a predetermined thickness to form an interference fit between the cap and the container neck for increasing resistance to cap backoff.

The gasket seal may have a non-circular shape such as octagonal, rectangular, or the like, forming interference protrusions, or may be provided with one or more tabs or ears providing protrusions forming the interference fit.

The gasket seal protrusions of elastomeric material are deformed by the threads on the cap and/or on the container neck for positively resisting torque backoff and thereby avoiding leakage of product from the container.

Other objects, advantages and all features of the invention will become more apparent from the following detailed description of the invention when taken in conjunction with the accompanying drawings.

DETAILED DESCRIPTION OF THE INVENTION

Figure 1:
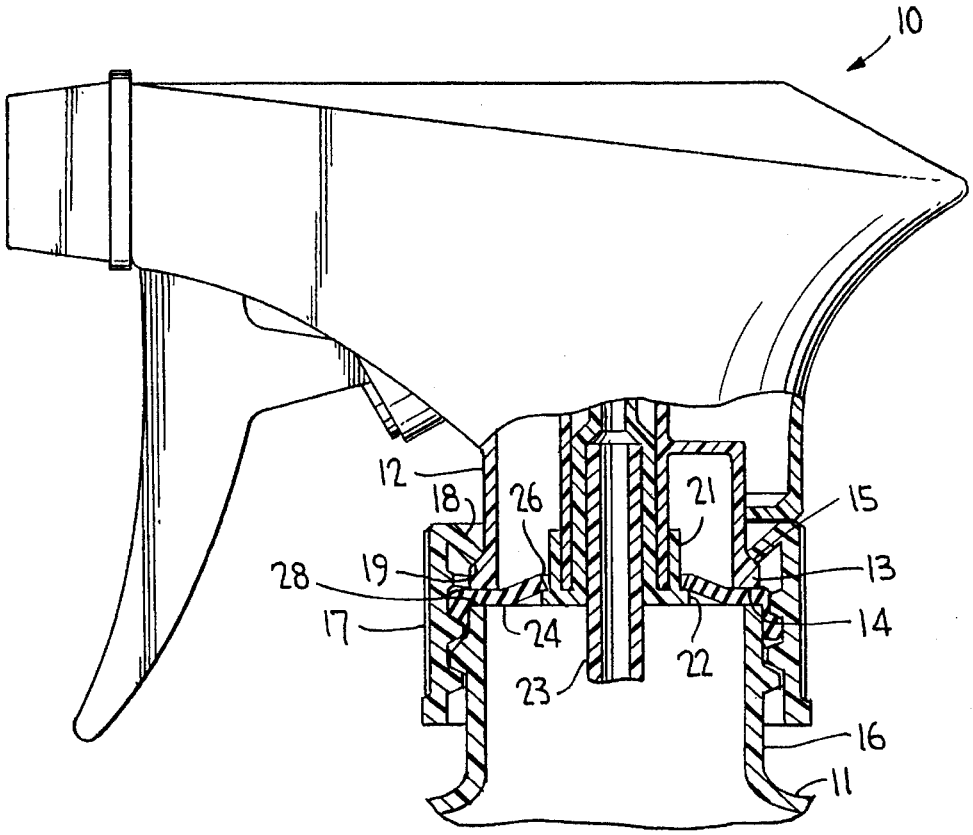
FIG. 1 is a side elevational view, partly in section, of a dispensing package incorporating the invention.

Turning now to the drawings wherein like reference characters refer to like and corresponding parts throughout the several views, a dispenser generally designated 10 is shown in FIG. 1 of the trigger operated type for the dispensing of a fluid upon pumping operation. The dispenser is mounted on a container 11 of fluid to be dispensed upon trigger operation of the dispenser.

The dispenser has a cylindrical attaching portion 12 with an external annular flange 13 adjacent its lower end wall 14. In the FIG. 1 embodiment, upper annular wall 15 is conical, similarly as in the U.S. Pat. No. 5,072,860. The dispenser body is mounted on an externally threaded neck 16 of the container by the provision of a closure cap 17 having internal threads which engage the external threads on the neck when the dispenser is tightly mounted in place as will be described in more detail hereinafter. The closure cap has a central opening bounded by an upper flange 18 to facilitate snap-fit engagement of the cap to portion 12 of the dispenser body. The flange is conical presenting a terminal edge wall 19, the skirt being sufficiently flexible to permit the cap being inserted over attaching portion 12 as the skirt flexes during subassembly.

A tube retainer 21 is mounted to the lower end of the pump body, the tube retainer having an external annular flange 22. The tube retainer supports a dip tube 23 extending into the container through which fluid is suctioned in the normal manner during pumping upon operation of the trigger actuator.

Figure 2:
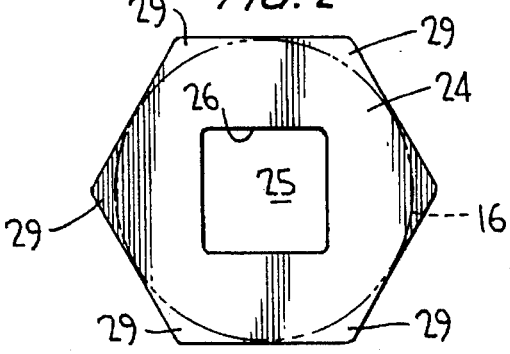
FIGS. 2, 3, 4 and 5 are plan views of gasket seals of various configurations according to the invention.
Figure 6:
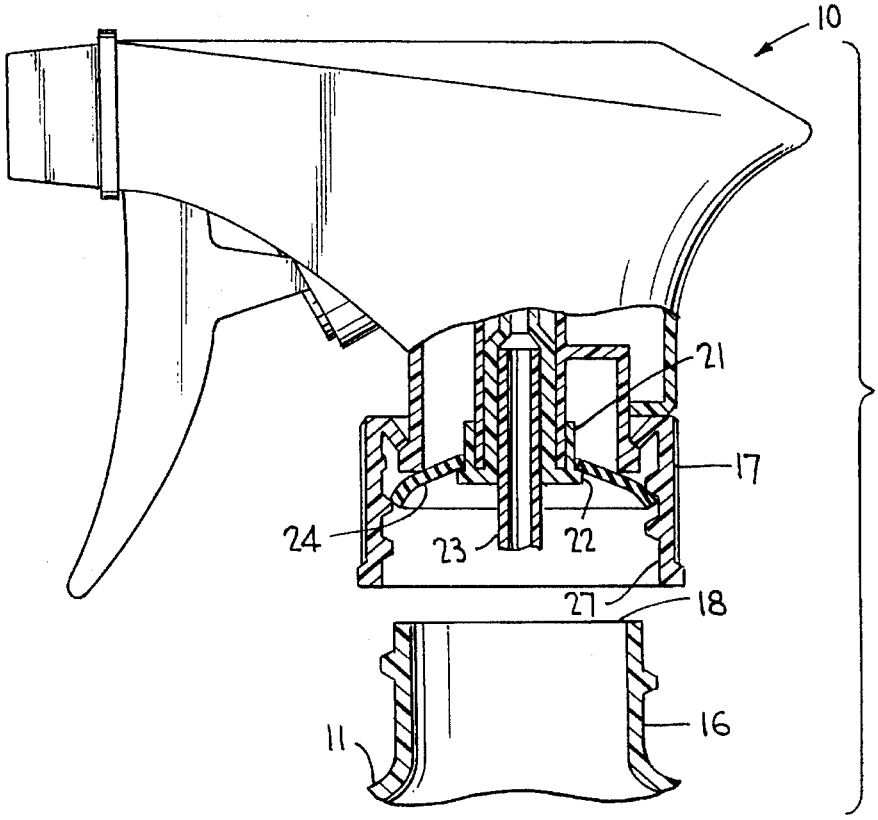
FIG. 6 is a view similar to FIG. 1 showing the dispenser prior to its closure cap being torqued down onto the container neck.

Referring to FIG. 6, showing the dispenser before being mounted on the container neck, gasket seal 24 according to the invention is subassembled with the dispenser, the gasket seal being of elastomeric material such as polyisobutylene, rubber or other plastic material having good sealing qualities and capable of deformation for providing the intended interference fit. As shown in FIG. 2, the gasket seal has a central, rectangular opening 25 presenting an edge wall 26 engaging flange 22 of the tube retainer to assist in retaining the gasket seal in place within the closure cap. However, even without the provision of flange 22, the gasket seal is capable of being retained in place within the closure cap during subassembly as will be made clear hereinafter. The rectangular central opening of the gasket seal presents four corner openings relative to the annular tube retainer to thereby define container vent opening passages from the atmosphere during the pumping operation. Also, central opening 25 for the gasket seal presents an opening through which dip tube 23 extends.

Gasket seal 24 is oversized relative to the inner dimension of the closure cap, such that during subassembly as shown in FIG. 6, the gasket seal is cupped into an "umbrella" shape, as it frictionally engages surface 27 of the closure cap, and/or the internal threads thereon. Likewise, the gasket seal is oversized relative to the outer diameter of the container neck, such that the gasket overlies upper edge 28 of the container neck, and one or more portions of the gasket protrude radially outwardly of that outer diameter when the closure cap is tightened in place.

In the FIG. 2 embodiment, gasket seal 24 may be of hexagonal shape, presenting six substantially triangular protrusions 29 extending radially outwardly relative to container neck 16 shown in phantom outline in FIG. 2. Outline 16 defines a main circular portion of the gasket seal.

When the closure cap is torqued down over the container neck from its position shown in FIG. 6 to that shown in FIG. 1, the gasket seal freely rotates together with the cap, and the internal threads of the cap bend protrusions 29 (radially extending beyond outline 16 as shown) downwardly to lie between the closure cap and the container neck, as shown in FIG. 1. The thickness of the elastomeric seal is greater than the normal spacing between inner surface 27 of the cap and the outer surface of the container neck such that protrusions 29 are slightly deformed, especially as a turn of the internal threads on the cap bite into one or more of the protrusions.

The gasket protrusions are bent into place upon the full thread tightening of the cap on the container neck to form an interference fit between the cap and the container neck for increasing the resistance to cap backoff, thereby preventing a loosening of the cap during shipping, storage and handling of the dispensing package as the gasket seal remains sealingly engaged with upper edge 28 of the container neck and lower edge 14 of the pump body. Free rotation of the gasket seal together with the cap facilitates the bending of the protrusions to form the interference fit. Any rotation of the dispenser body or slippage of the gasket causing cap loosening and product leakage seal is positively avoided.

Figure 3:
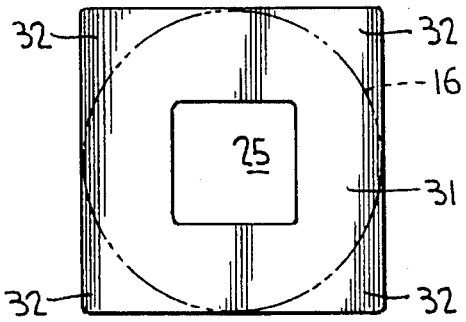
Figure 4:
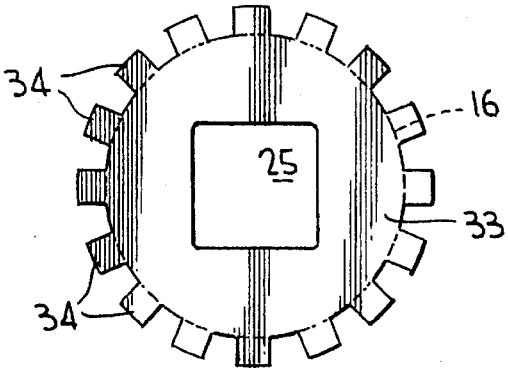
Figure 5:
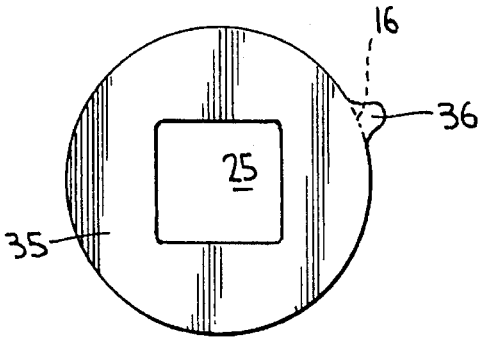

Other overall shapes for the gasket seal are made possible within the scope of the invention. For example, gasket seal 31 shown in FIG. 3 may be square shaped to define four substantially triangular protrusions 32 radially extending beyond outline 16. Or, gasket seal 33 of FIG. 4 may be provided with a plurality of spaced protrusions 34 extending along the entirety or a selected portion of the periphery beyond outline 16. Otherwise, gasket seal 35 of FIG. 5 may be provided with a single protrusion 36 radially extending beyond outline 16. The protrusions 32, 34 and 36 of the various gasket seals function in the same manner as described with reference to the FIG. 2 gasket seal. Moreover, the gasket seal could be of triangular shape presenting three protrusions, oval shapes, or other shapes.

Figure 7:
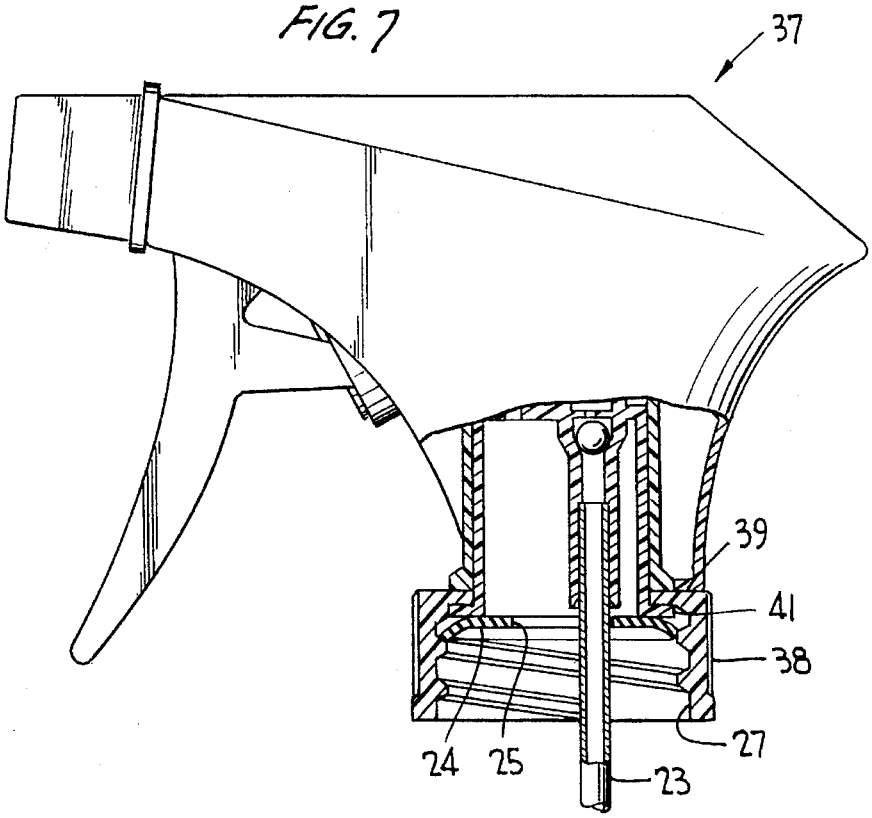
FIG. 7 is a view similar to FIG. 1 of another type trigger sprayer incorporating the invention.

The trigger actuated fluid dispenser generally designated 37 in FIG. 7 is essentially the same as dispenser 10 except that closure cap 38 is retained on the pump body in a slightly different manner. Cap 38 has an internal, transversely extending upper flange 39 in engagement with an external flange 41 at the lower end of the pump body. Gasket seal 24 is retained in place within the closure cap, prior to torquing down the cap over the container neck, as the relatively oversized gasket seal is cupped into the umbrella shape shown upon engagement with inner surface 27 of the closure cap and/or the internal threads thereof. As in the FIG. 1 embodiment, dip tube 23 extends through central opening 25 of the gasket seal, which opening may be circular. The oversized opening 25 relative to the diameter of the dip tube also provides a container vent passage for venting the contents of the container to atmosphere during the pumping operation. Otherwise, the interference fit provided by the protrusions formed on the elastomeric gasket seal of FIG. 7 is the same as described with reference to FIG. 1.

From the foregoing, it can be seen that the anti-backoff feature of the invention is effected in a practical and highly economical manner without the need for retooling any of the components of the dispensing package, by simply devising the elastomeric gasket seal as oversized to present at least one protrusion having a thickness presenting an interference fit between the closure cap and the container neck for increasing resistance to cap backoff. Moreover, the trigger sprayer may be positively oriented on the container without slippage as any turning of the trigger sprayer will be effectively resisted by the interference fit effected by the invention.

Obviously, many other modifications and variations of the present invention are made possible in the light of the above teachings. It is therefore to be understood that within the scope of the appended claims, the invention may be practiced otherwise than as specifically described.

What is claimed is:

1. A trigger operated fluid dispenser mounted on a container of product to be dispensed, a dip tube extending from the dispenser into the container, a freely rotatable, internally threaded closure cap in engagement with the dispenser for threadedly engaging an externally threaded neck of the container, a gasket within the cap providing a fluid tight seal between the dispenser and the container, said gasket having an opening through which the dip tube extends, the improvement wherein said gasket is oversized in relation to a minimum inner diameter of said closure cap, the oversized gasket comprising a main circular portion and at least one protrusion extending radially outwardly of said main portion initially in frictional engagement with said cap for free rotation together therewith, said protrusion being bent by said cap to lie between said cap and said container neck upon thread tightening said cap on said container neck, said protrusion having a predeterminal thickness as to form an interference fit between said cap and said container neck for increasing resistance to cap backoff.

2. The dispenser according to claim 1, wherein said gasket is hexagonal in shape comprising said main circular portion and six protrusions extending radially outwardly thereof, said protrusions being bent by said cap upon said thread tightening to form the interference fit.

3. The dispenser according to claim 1, wherein said gasket is square shaped comprising said main circular portion and four protrusions extending radially outwardly of said thereof, said protrusions being bent by said cap upon said thread tightening to form the interference fit.

4. The dispenser according to claim 1, wherein said protrusion comprises an outwardly extending tab.

* * * * *